US012324461B2

(12) United States Patent
Garbinciute et al.

(10) Patent No.: US 12,324,461 B2
(45) Date of Patent: Jun. 10, 2025

(54) BRASSIERE WITH CUPS HAVING REINFORCING ELEMENTS

(71) Applicants: Giedre Garbinciute, Vilnius (LT); Michael Onghai, Phoenix, AZ (US)

(72) Inventors: Giedre Garbinciute, Vilnius (LT); Michael Onghai, Phoenix, AZ (US)

(73) Assignee: Giedre Garbinciute, Vilnius (LT)

( * ) Notice: Subject to any disclaimer, the term of this patent is extended or adjusted under 35 U.S.C. 154(b) by 0 days.

(21) Appl. No.: 18/381,654

(22) Filed: Oct. 19, 2023

(65) Prior Publication Data

US 2025/0127241 A1 Apr. 24, 2025

(51) Int. Cl.
*A41C 3/00* (2006.01)

(52) U.S. Cl.
CPC ..... *A41C 3/0007* (2013.01)

(58) Field of Classification Search
CPC ..... A41C 3/0007
See application file for complete search history.

(56) References Cited

U.S. PATENT DOCUMENTS 154,027 A * 8/1874 Dyer
2,443,127 A * 6/1948 Abeles ..... A41C 3/06 D2/706
2,457,989 A * 1/1949 Ettleson ..... A41C 3/06 450/44
2,472,765 A * 6/1949 Shulman ..... A41C 3/06 D2/706
2,524,620 A * 10/1950 Cadous ..... A41C 3/06 D2/706
2,759,190 A * 8/1956 Herbener ..... A41C 3/06 450/41
2,824,563 A * 2/1958 Hill ..... A41C 3/0007 450/39
2,880,732 A * 4/1959 Smith ..... A41C 3/06 450/52

(Continued)

FOREIGN PATENT DOCUMENTS

CN 204635104 U 9/2015
CN 206565310 U 10/2017

(Continued)

*Primary Examiner* — Gloria M Hale
(74) *Attorney, Agent, or Firm* — Shlomo Horowitz; Shlomo Horowitz Patents and Intellectual Property Ltd.

(57) ABSTRACT

A brassiere with cups to receive large women's breasts has on each cup at least two rigid or semi-rigid reinforcing members that include (A) two reinforcing members that intersect to substantially form a T intersection, (B) three reinforcing members that intersect to substantially form an H, and/or (C) two reinforcing members that intersect to substantially form a plus sign. In another implementation, each cup comprises two rigid or semi-rigid reinforcing members that intersect at an angle of 70-90 degrees. In another implementation, each cup includes three rigid or semi-rigid reinforcing members including two that substantially form a first T intersection and two that substantially form a second T intersection whereby one of the at least three reinforcing members represents a leg of the first T intersection and represents a top of the second T intersection. In another implementation, three nonparallel reinforcing members intersect at an endpoint of the middle member.

33 Claims, 6 Drawing Sheets

(56) References Cited

U.S. PATENT DOCUMENTS

| | | | | | |
|---|---|---|---|---|---|
| 2,965,103 | A | * | 12/1960 | Blair | A41C 3/0007 450/42 |
| 3,030,961 | A | * | 4/1962 | Erteszek | A41C 3/06 450/67 |
| 3,030,962 | A | * | 4/1962 | Garson | A41C 3/06 450/41 |
| 3,066,677 | A | * | 12/1962 | Steiner | A41C 3/0007 D2/708 |
| 3,750,673 | A | | 8/1973 | Penrock | |

FOREIGN PATENT DOCUMENTS

| | | | |
|---|---|---|---|
| EP | 2222196 | B1 | 5/2013 |
| FR | 2924901 | A1 | 6/2009 |
| JP | H07252704 | A | 10/1995 |
| JP | H09188902 | A | 7/1997 |
| JP | 2022030052 | A | 2/2022 |
| WO | WO2009101287 | A2 | 8/2009 |

* cited by examiner

BRASSIERE WITH CUPS HAVING REINFORCING ELEMENTS

FIELD OF THE INVENTION

The invention is in the field of ladies' garments, and more particularly those having reinforcing elements, for example for large breasted women.

BACKGROUND OF THE INVENTION

Brassieres do not adequately secure the breasts of large-breasted women. The straps and the band usually fulfill this function. Sturdier straps reduce the amplitude of the oscillation of the breasts. If the straps are elastic, they do not reduce the oscillation as much as needed. If the straps are made of fabric, and therefore are more rigid, they further reduce the oscillation but since they do not stretch so much they may well restrict arm and shoulder motion. In addition, fabric straps may be uncomfortable to wear due to body changes throughout the day and due to the fact that they apply force to the shoulder quickly instead of letting the force build up gradually.

SUMMARY OF THE EMBODIMENTS

Applicant has found that side to side motion and up and down motion of the breasts needs to be secured in order to prevent discomfort, excess perspiration, the need for adjusting the garment and other problems. For example, when stepping or jumping causes a prolonged reactive motion of the breasts responsive to that single motion, the reactive motion is called jiggling of the breasts. This is particularly relevant to busty or large breasted women. Applicant has found that straps are inadequate at preventing jiggling and at preventing the combination of horizontal and vertical motion of the breasts, particularly for large-breasted women.

Furthermore, Applicant has also found that sports bras are not a practical solution since they compress the breasts and distort the most attractive appearance of the breasts.

One embodiment is a brassiere, comprising: a concave left cup and a concave right cup, each cup having an inside surface and an outside surface, each cup configured to receive a women's breastthat is defined as large by a predetermined criteria; and one or more of (i) left and right sides, (ii) a back and (iii) at least one strap, wherein each cup comprises at least two rigid or semi-rigid reinforcing members, wherein the at least two rigid or semi-rigid reinforcing members of each cup comprise one or more of the following:

(A) two reinforcing members that intersect to substantially form a T intersection, (B) three reinforcing members that intersect to substantially form an H, and (C) two reinforcing members that intersect to substantially form a plus sign.

In some embodiments, the at least two rigid or semi-rigid reinforcing members of each cup comprise three reinforcing members that intersect to substantially form the H. In some embodiments, a crossbar of the H extends outwardly on each side of the H.

In some embodiments, the at least two rigid or semi-rigid reinforcing members of each cup include two reinforcing members that intersect to substantially form the T intersection at an angle of from 75 to 90 degrees and at some point along an interval from one-quarter of a length of, to three-quarters of the length of, one of the two intersecting reinforcing members.

In some embodiments, the at least two rigid or semi-rigid reinforcing members of each cup include two reinforcing members that intersect to substantially form a T intersection. In some embodiments, a first of the two reinforcing members that intersect to substantially form the T intersects with a second of the two reinforcing members that intersect to substantially form the T at an angle of between 50 and 90 degrees. In some embodiments, a first of the two reinforcing members that intersect to substantially form the T intersects with a second of the two reinforcing members that intersect to substantially for the T at an angle of between 70 and 90 degrees. In some embodiments, for each cup, one of the two reinforcing members that intersect to substantially form the T substantially bisects a surface area of the outside surface. In some embodiments, for each cup, both of the two reinforcing members of that intersect to substantially form the T occupy a surface area that is less than half of a surface area of the outside surface.

In some embodiments, the at least two rigid or semi-rigid reinforcing members of each cup include two reinforcing members that intersect to substantially form a plus sign.

Another embodiment is a brassiere, comprising: a concave left cup and a concave right cup, each cup having an inside surface and an outside surface, each cup configured to receive a woman's breast; and one or more of (i) left and right sides, (ii) a back and (iii) at least one strap, wherein each cup comprises two rigid or semi-rigid reinforcing members that intersect with one another at an angle of 70-90 degrees.

In some embodiments, the brassiere further comprises a third rigid or semi-rigid reinforcing member that intersects with each of the two rigid or semirigid reinforcing members. In some embodiments, the third rigid or semi-rigid reinforcing member substantially forms a leg or a top of at least one T intersection.

In some embodiments, the two rigid or semi-rigid reinforcing members intersect with one another at an angle of at 75-90 degrees.

In some embodiments, the two rigid or semi-rigid reinforcing members intersect with one another at an angle of 80-90 degrees.

In some embodiments, the two rigid or semi-rigid reinforcing members are substantially orthogonal to one another.

In some embodiments, the two intersecting rigid or semi-rigid reinforcing members intersect at an angle of from 75 to 90 degrees and at some point along an interval from one-quarter of a length of, to three-quarters of the length of, the one of the two intersecting reinforcing members.

A further embodiment is a brassiere, comprising: a concave left cup and a concave right cup, each cup having an inside surface and an outside surface, each cup configured to receive a women's breast; and one or more of (i) left and right sides, (ii) a back and (iii) at least one strap, wherein each cup includes at least three rigid or semi-rigid reinforcing members, wherein the at least three rigid or semi-rigid reinforcing members of each cup include two reinforcing members that substantially form a first T intersection and two reinforcing members that substantially form a second T intersection, wherein one of the at least three rigid or semi-rigid reinforcing members of each cup represents a leg of the first T intersection and represents a top of the second T intersection.

In some embodiments, two of the at least three rigid or semi-rigid reinforcing members are substantially parallel to one another. In some embodiments, the two of the at least three rigid or semi-rigid reinforcing members that are substantially parallel do not include the one of the three rigid or semi-rigid reinforcing members that represents a leg of the first T intersection and represents a top of the second T intersection.

In some embodiments, for each particular cup of the left cup and right cup, one of the three rigid or semi-rigid reinforcing members extends from a bottom to a top of the particular cup.

In some embodiments, the two reinforcing members that substantially form the first T intersection intersect at an angle of from 75 to 90 degrees.

In some embodiments, the two reinforcing members that substantially form the first T intersection intersect at an angle of from 75 to 90 degrees at some point along an interval from one-quarter of a length of, to three-quarters of the length of, the one of the two reinforcing members that represents the top of the first T intersection.

A still further embodiment is a brassiere, comprising: a concave left cup and a concave right cup, each cup having an inside surface and an outside surface, each cup configured to receive a women's breast; and one or more of (i) left and right sides, (ii) a back and (iii) at least one strap, wherein each cup comprises three nonparallel rigid or semi-rigid reinforcing members.

In some embodiments, the three nonparallel reinforcing members include a medial reinforcing member, a middle reinforcing member and a lateral reinforcing member, wherein either (A) at least one of the medial and lateral reinforcing members intersects the middle reinforcing member or (B) the medial and lateral reinforcing members are substantially symmetrical in relation to the middle reinforcing member. In some embodiments, in each cup the middle reinforcing member runs substantially vertically from a bottom to a top of the respective cup. In some embodiments, in each cup the medial and lateral reinforcing members intersect the middle reinforcing member at an angle of 30 degrees to 60 degrees. In some embodiments, the medial reinforcing member intersects the lateral reinforcing member at an angle of 70 to 110 degrees. In some embodiments, the three reinforcing members intersect. In some embodiments, each of the medial and lateral reinforcing members intersect the middle reinforcing member.

In some embodiments, the three nonparallel reinforcing members include a first reinforcing member that is substantially vertical and a second and third reinforcing member at least one of which intersects with the first reinforcing member. In some embodiments, the three nonparallel reinforcing members substantially form a K.

In some embodiments, all of the three nonparallel reinforcing members intersect with one another.

BRIEF DESCRIPTION OF THE DRAWINGS

Various embodiments are herein described, by way of example only, with reference to the accompanying drawings, wherein.

DETAILED DESCRIPTION OF THE EMBODIMENTS

Figure 1:
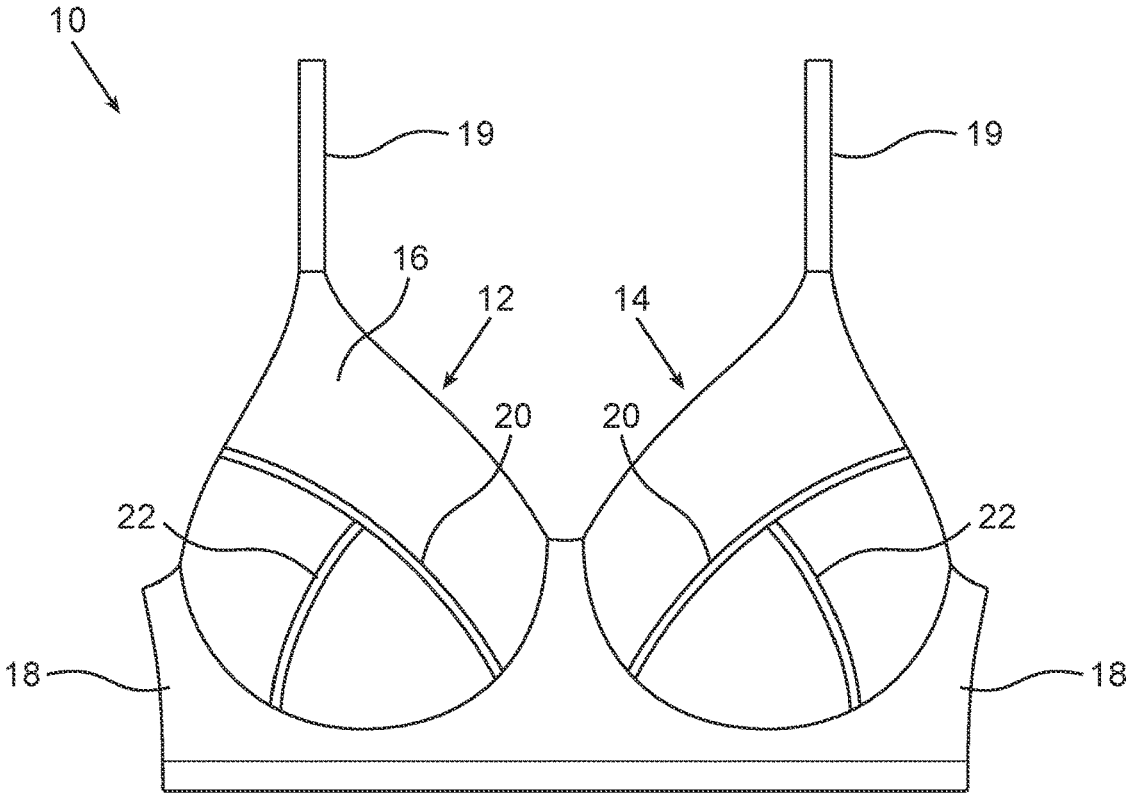
FIG. 1 is a schematic of a brassiere showing a pattern of two reinforcing elements on the cups thereof, in accordance with one embodiment.

The following detailed description is of the best currently contemplated modes of carrying out the invention. The description is not to be taken in a limiting sense, but is made merely for the purpose of illustrating the general principles of the invention, since the scope of the invention is best defined by the appended claims.

The embodiments generally provide a brassiere having special reinforcing sections or elements that allow it to successfully stabilize the breasts of women in general, and especially those of large-breasted women, from both unwanted vertical motion and unwanted horizontal motion. As a result, the brassiere worn by the wearer holds the breasts comfortably while moving about normally—including stepping and jumping—and jiggling is significantly reduced. As a result of this extra stability achieved by certain embodiments herein, the brassiere with the reinforcing members herein also reduces back pain associated particularly with large-breasted women and prevents or reduces the long-term sagging of their breasts.

The reinforcing members may be rigid or semi-rigid and may be situated in the area of the cups. For example, in some embodiments, they are situated on the outside surface of the cup or embedded into the material of the cups, for example by being sewn therein. The special patterns may comprise the rigid or semi-rigid reinforcing elements that may include both vertical reinforcement elements and horizontal reinforcement elements.

Applicant has tested the embodiments of the brassiere that have both vertical and horizontal reinforcing elements on the cups of the brassiere. Applicant has compared this to the brassieres of the prior art which do not have such a pattern of reinforcing elements on the cups. Applicant has found that the tested embodiments having both the vertical and horizontal reinforcement elements inhibited both unwanted side to side motion and unwanted up and down motion of the breasts, and in particular inhibited jiggling of breasts that are considered large sized breasts by predetermined criteria. Applicant found that jiggling of large women's breasts are greatly reduced by the special patterns of reinforcing elements situated in the area of the cups themselves. Furthermore, Applicant has found that this effect is most pronounced with the special patterns of the reinforcing members in the embodiments herein wherein the reinforcing element on the cups are found on each of the cups and wherein each cup has one or more of the following patterns of reinforcing members thereon:

(i) two reinforcing members that intersect to substantially form a T intersection, (ii) three reinforcing members that intersect to substantially form a capital H, (iii) two reinforcing members that intersect to substantially form a plus sign, (iv) two reinforcing members that intersect at an angle of 70-90 degrees, (v) three reinforcing members include two that substantially form a first T intersection and two that substantially form a second T intersection, one of the three reinforcing members is simultaneously a leg of the first T intersection and a top of the second T intersection, (vi) three non-parallel reinforcing members, for example, where one or two of the three reinforcing members intersects along a middle one of the three reinforcing members (in the case where two of the three reinforcing members intersect then in some versions they intersect at the same point and in other versions they intersect at different points along the middle one of the three reinforcing members) or where two of the three reinforcing members are substantially symmetrical in relation to the middle one of the reinforcing members.

(vii) three non-parallel reinforcing members that substantially form the English letter "K".

The above list of patterns is not intended to be exhaustive or limiting.

In another embodiment, each cup includes a curved reinforcement element that has both a component that extends in a horizontal direction and a separate component that extends in a vertical direction.

The term "about" as used herein means plus or minus 5% of the number used. For example "about 20" means from and including 19 to and including 21.

The principles and operation of A Brassiere With Cups Having Reinforcing Elements may be better understood with reference to the drawings and the accompanying description.

As shown in FIG. 1 through FIG. 4, one embodiment is a brassiere 10, especially for large-breasted women. The brassiere 10 may include a concave left cup 12 and a concave right cup 14, each cup 12, 14 having an inside surface (not shown) and an outside surface 16 (FIG. 1). "Inside surface" does not refer to an inner lining but rather to the visible surface on the inner concavity of the cup 12, 14. "Left" and "right" are defined herein from the perspective of someone standing in front of the wearer and viewing the brassiere 10 while it is being worn (and similarly these words correspond to the left and right sides of the figures depicted in the drawing sheets as they appear to someone looking at the drawing sheets).

Each cup 12, 14 may be configured in concavity and surface area to receive a women's breast that is defined as large by a predetermined criteria. One example of a predetermined criteria is a size defined or used in the ladieswear garment industry.

Figure 2:
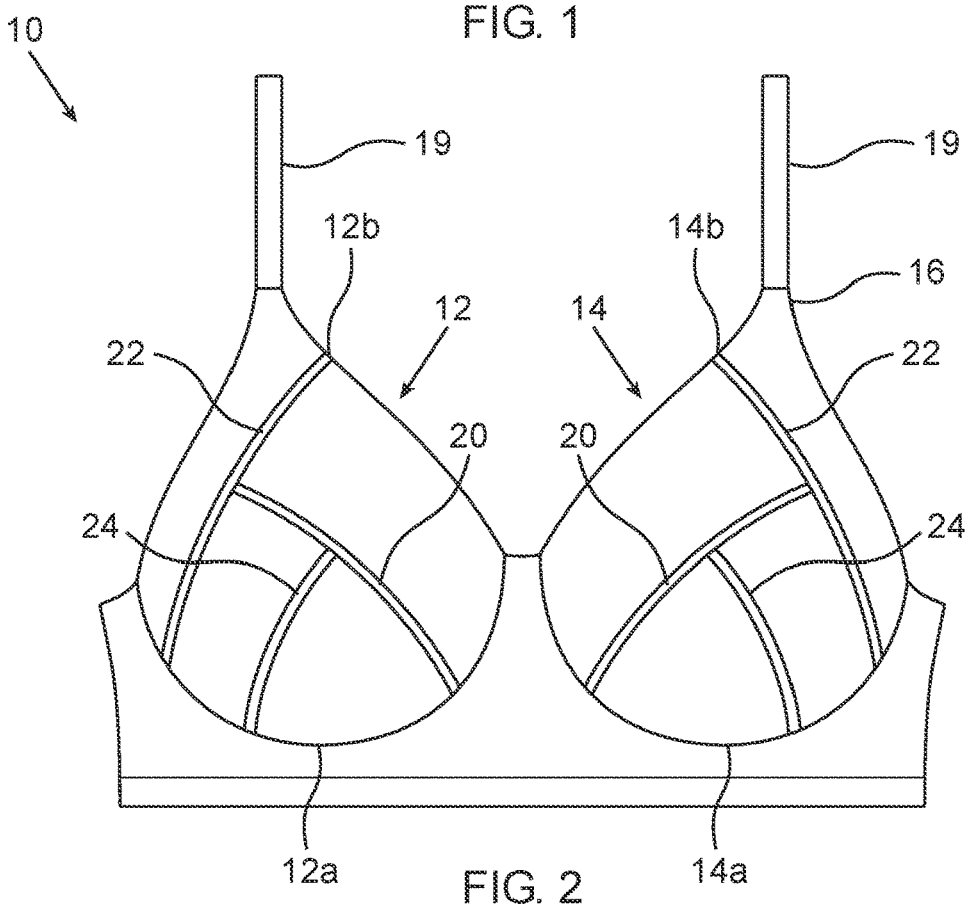
FIG. 2 is a schematic of a brassiere showing a pattern of three reinforcing elements on the cups thereof, in accordance with one embodiment.

Brassiere 10 may have one or more of (a) left and right sides 18 (FIG. 1), (b) a back (not shown) and (c) at least one strap 19 (FIG. 2).

Each cup 12, 14 may comprise two or at least two rigid or semi-rigid reinforcing members 20, 22 (or three reinforcing members 20, 22, 24 or four 20, 22, 24, 26 or five 20, 22, 24, 26, 28 etc.). The at least two rigid or semi-rigid reinforcing members 20, 22 of each cup 12, 14 may include two, three, four, five or six reinforcing members, Non-limiting examples of this include one or more of the following:

two reinforcing members that intersect to substantially form a T intersection, three reinforcing members that intersect to substantially form an H, two reinforcing members that intersect to substantially form a plus sign.

References herein to a "T" or to a "T intersection" encompass both a capital "T" and a lower case "T" (in a lower case "T" the top of the "T" does not cross at the uppermost point of the "T").

In some implementations, the reinforcing members are formed using substantially straight lines. In some other embodiments, some or all of the reinforcing members or parts thereof are formed using curved lines.

Figure 3:
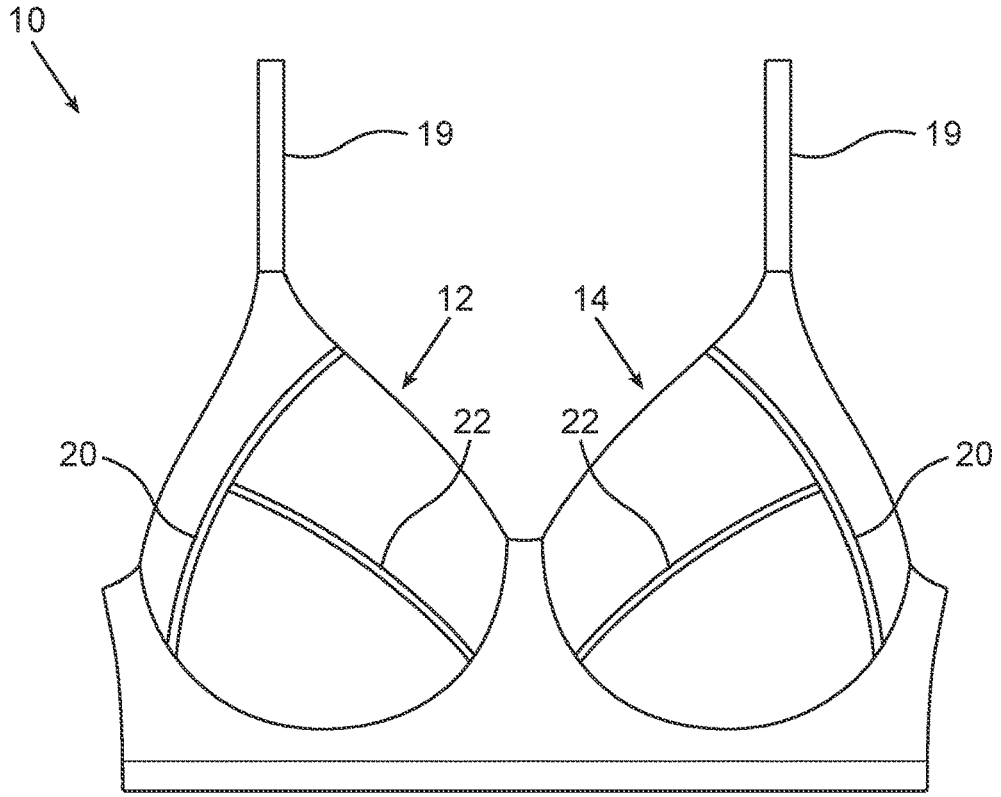
FIG. 3 is a schematic of a brassiere showing a further pattern of two reinforcing elements on the cups thereof, in accordance with one embodiment.
Figure 5:
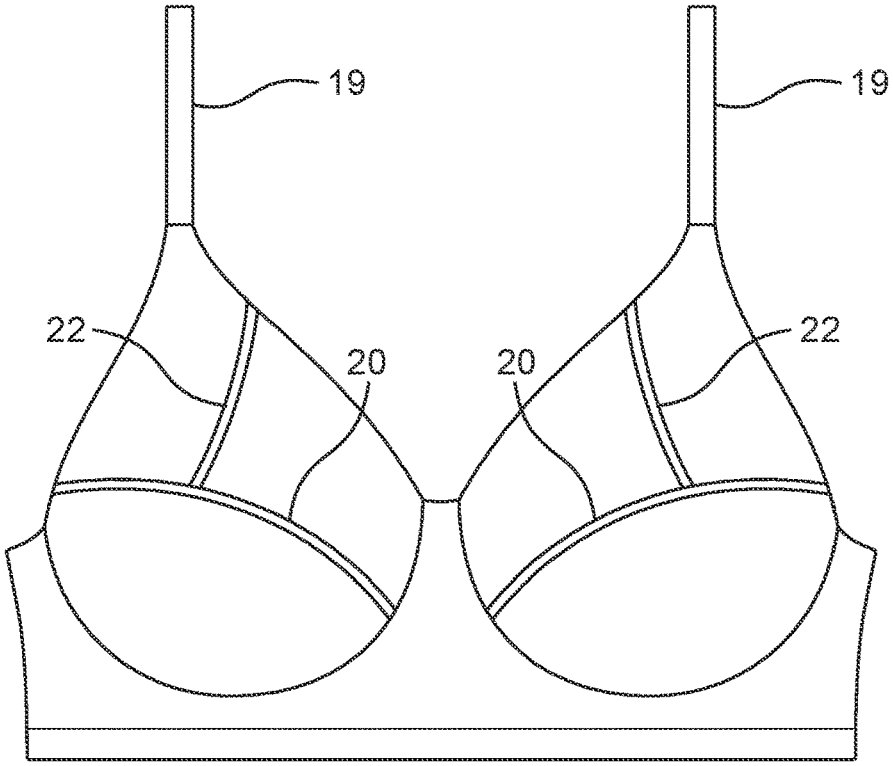
FIG. 5 is a schematic of a brassiere showing a further pattern of two reinforcing elements on the cups thereof, in accordance with one embodiment.
Figure 6:
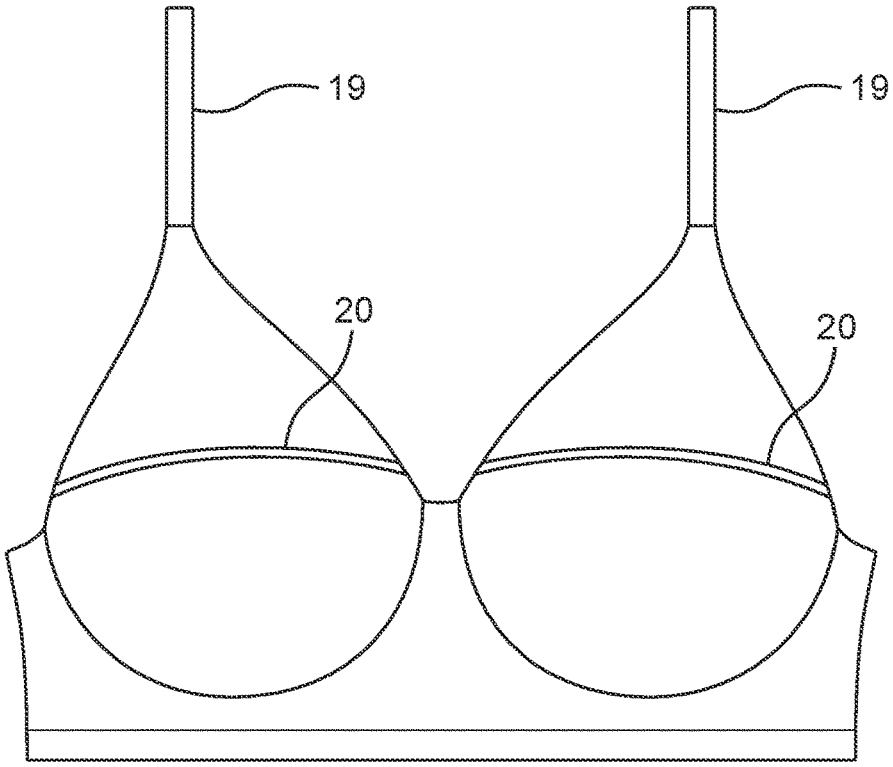
FIG. 6 is a schematic of a brassiere showing a pattern of a curved reinforcing element on the cups thereof, in accordance with one embodiment.
Figure 7:
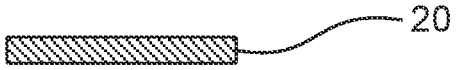
FIG. 7 is a cross-section view of a reinforcing member, in accordance with one embodiment.

As shown in FIG. 1, FIG. 3 and FIG. 5, two reinforcing members 20, 22 may intersect on each cup 12, 14 to substantially form at least one T intersection. In some embodiments, the at least two rigid or semi-rigid reinforcing members of each cup include two reinforcing members that intersect to substantially form the T intersection at an angle of from 75 to 90 degrees. In some embodiments, the two reinforcing members 20, 22 intersect in a middle half of one of the length of the one of the reinforcing members. This means that they intersect and at some point along an interval from one-quarter of a length of, to three-quarters of the length of, one of the two intersecting reinforcing members 20, 22.

It should be understood from basic geometry that any reference herein to the formation of an intersection of two reinforcing members at an angle of 75-90 degrees means that a complementary angle is automatically simultaneously formed—in this case a complementary angle of 90-105 degrees.

The at least two rigid or semi-rigid reinforcing members of each cup may include the two reinforcing members that intersect to substantially form the T intersection. In some embodiments, a first of the two reinforcing members that intersect to substantially form the T intersects with a second of the two reinforcing members that intersect to substantially for the T at an angle of between 50 and 90 degrees or in other versions between 60 degrees and 90 degrees or in other versions between 70 degrees and 90 degrees or between 80 degrees and 90 degrees.

In some embodiments, for each cup, as shown in FIG. 1, one of the two reinforcing members that intersect to substantially form the T substantially—for example the top (as opposed to the leg of the T) bisects a surface area of the outside surface. In some versions, as shown in FIG. 5, for each cup, both of the two reinforcing members of that intersect to substantially form the T occupy a surface area that is less than half of a surface area of the outside surface.

In some embodiments in which the reinforcing members on each cup form at least one T intersection, as shown in FIG. 2, there are three or at least three reinforcing members. As shown in FIG. 2, each cup may include at least three rigid or semi-rigid reinforcing members. In order to optimize the stabilization of the large breasted woman, the at least three rigid or semi-rigid reinforcing members of each cup include two reinforcing members that substantially form a first T intersection and two reinforcing members that substantially form a second T intersection. For example, as shown in FIG. 2, in some versions, one of the at least three rigid or semi-rigid reinforcing members of each cup may be or represent a leg of the first T intersection and may simultaneously be or represent a top of the second T intersection. In some embodiments, two of the at least three rigid or semi-rigid reinforcing members are substantially parallel to one another, although that is not required.

As shown in FIG. 2, in some embodiments, the two (of the at least three) rigid or semi-rigid reinforcing members (that are substantially parallel to one another) do not include the reinforcing member that is the leg of the first T intersection and the top of the second T intersection.

As shown in FIG. 2, in some embodiments, for the left cup and right cup, one of the three rigid or semi-rigid reinforcing members extends from a bottom 12*a*, 14*a* to a top 12*b*, 14*b* of the cup 12, 14.

In some embodiments, the two reinforcing members that substantially form the first T intersection intersect at an angle of from 75 to 90 degrees. In some embodiments, the two reinforcing members that substantially form the first T intersection intersect at an angle of from 75 to 90 degrees at some point along an interval from one-quarter of a length of, to three-quarters of the length of, the one of the two reinforcing members that represents the top of the first T intersection.

Figure 4:
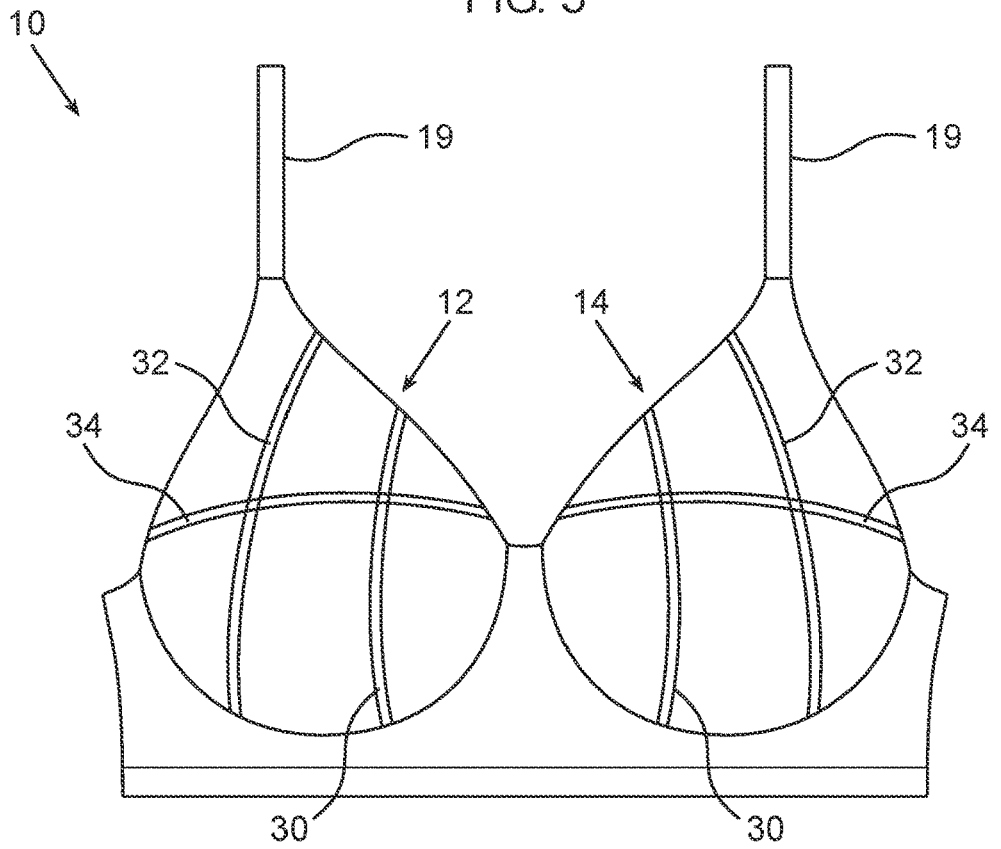
FIG. 4 is a schematic of a brassiere showing a further pattern of three reinforcing elements on the cups thereof, in accordance with one embodiment.

As seen from FIG. 4, in some embodiments, the at least two rigid or semi-rigid reinforcing members comprise three reinforcing members 30, 32, 34 that intersect to substantially form a capital "H". As shown in FIG. 4, the capital H may include two legs 30, 32 and a crossbar 34. In some embodiments, the crossbar of the H extends outwardly on each side of the H as shown in FIG. 4. In some embodiments, as seen in FIG. 4, the lengths of the two legs 30, 32 are not equal. In other embodiments, the lengths of legs 30, 32 are substantially equal or equal. In some embodiments, the two legs 30, 32 of the H are substantially parallel.

In some embodiments, the two rigid or semi-rigid reinforcing members 20, 22 (of each cup 12, 14) that intersect do so to substantially form a plus sign. In some embodiments, the two reinforcing members 20, 22 (of each cup 12, 14) that intersect do so to substantially form an orthogonal intersection between a vertical axis and a horizontal axis.

Another embodiment is a brassiere 10 that may include a concave left cup 12 and a concave right cup 14, each cup 12, 14 having an inside surface and an outside surface, each cup configured to receive a woman's breast that is defined as large by a predetermined criteria and one or more of (i) left and right sides, (ii) a back and (iii) at least one strap. Each cup 12, 14 may comprise two rigid or semi-rigid reinforcing members 20, 22 that intersect with one another at an angle of 70-90 degrees (or in other version at 75-90 degrees or in other versions at 80-90 degrees). In some implementations of this embodiment, each cup 12, 14 may also have a third rigid or semi-rigid reinforcing member that intersects with each of the two rigid or semirigid reinforcing members. In some implementations of this embodiment, the third rigid or semi-rigid reinforcing member substantially forms a leg or a top of at least one T intersection.

In some embodiments, there are two rigid or semi-rigid reinforcing members that are substantially orthogonal to one another.

In some embodiments, the two intersecting rigid or semi-rigid reinforcing members intersect at an angle of from 75 to 90 degrees and at some point along an interval from one-quarter of a length of, to three-quarters of the length of, one of the two intersecting reinforcing members.

In some embodiments, the width of each of the reinforcing members is between about 1.0 mm and about 15.0 mm. In some embodiments, the width of each of the reinforcing members is between about 1.5 mm and about 6.0 mm. In some embodiments, the width of each reinforcing member is from about 2 mm to about 6 mm. In some embodiments, the width of each reinforcing member is from about 2 mm to about 4 mm or about 3 mm to about 5 mm or from about 3 mm to about 4 mm. Typically, each of the reinforcing members are of the same or similar width.

In another embodiment, shown in FIG. 8A, FIG. 8B, FIG. 8C and FIG. 8D, each cup 12, 14 of brassiere 10 has a pattern of (at least) three reinforcing members 20, 22, 24. For example, brassiere 10 may include a concave left cup 12 and a concave right cup 14, each cup 12, 14 having an inside surface and an outside surface, each cup 12, 14 configured to receive a women's breast that is defined as large by a predetermined criteria; and one or more of (i) left and right sides, (ii) a back and (iii) at least one strap. Each cup 12, 14 may comprise three nonparallel rigid or semi-rigid reinforcing members, for example (FIG. 8A) a medial reinforcing member 22, a middle reinforcing member 20 and a lateral reinforcing member 24.

The terms "medial" and "lateral" are defined with respect to the body. Therefore, looking at FIG. 8A for example, in the left cup 12 (as viewed from an outside observer (not the wearer) looking at the brassiere 10), the medial reinforcing member 22 appears to the right of middle reinforcing member 20 whereas in the right cup 14 the medial reinforcing member 22 appears to the left of the middle reinforcing member 20.

Figure 8A:
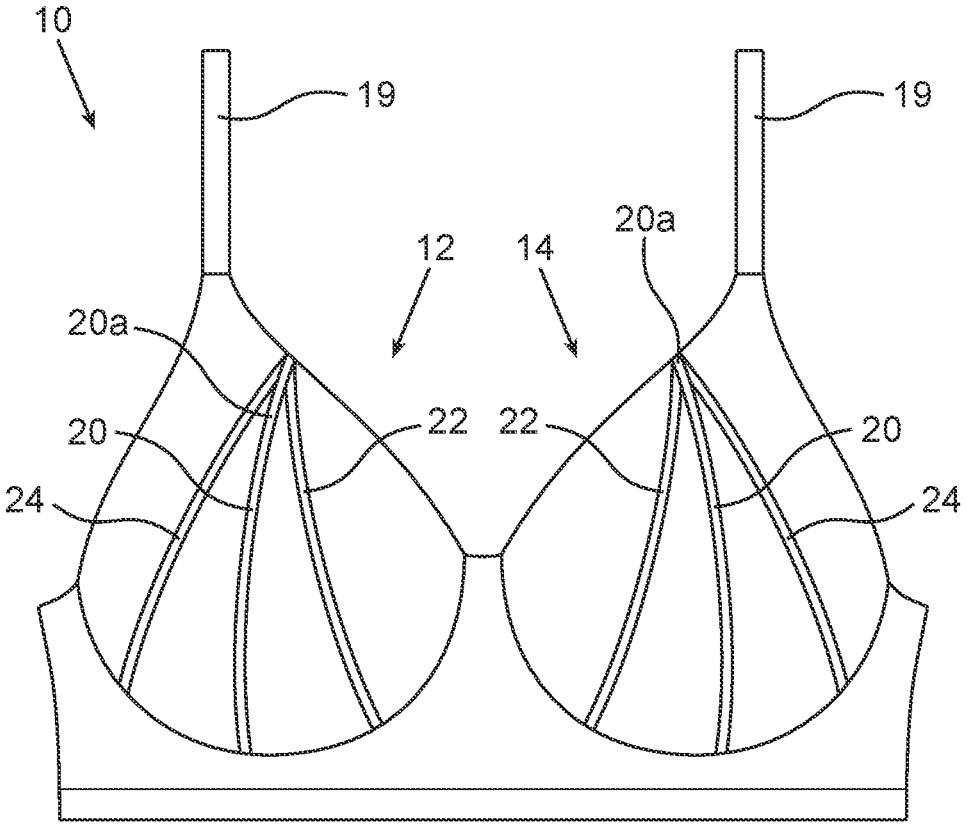
FIG. 8A is a schematic view of a further pattern of three reinforcing members, in accordance with one embodiment.

Likewise, looking at FIG. 8A, in the left cup 12, the lateral reinforcing member 24 appears to the left of middle reinforcing member 20 whereas in the right cup 14 the lateral reinforcing member 24 appears to the right of the middle reinforcing member 20.

In some implementations of the three nonparallel rigid or non-rigid reinforcing members 20, 22, 24, either (A) two or three of the three reinforcing members 20, 22, 24 intersect with one another, for example in the non-limiting example of FIG. 8A one or both of the medial and lateral reinforcing member 22, 24 intersects with the third reinforcing member 20 or (B) two of the reinforcing members, in the non-limiting example of FIG. 8A the medial and lateral reinforcing members 22, 24, are substantially symmetrical in relation to the third reinforcing member. For example, the medial and lateral reinforcing members 22, 24 are substantially symmetrical in relation to the middle reinforcing member 20, meaning that if one were to fold one of the cups 12, 14 along one of the three reinforcing members (for example the middle reinforcing member 20), the other two reinforcing members 22, 24 would substantially line up.

In one implementation of option "(A)" above, and as shown in FIG. 8A, the medial and lateral reinforcing members 22, 24 intersect with the third reinforcing member 20 (i.e. the middle reinforcing member 20) at the same point. In some embodiments, this point is within an end region 20*a* (or at an exact end) of the third or middle reinforcing member 20. The term "end region 20*a*" means somewhere along the last 25% of the length of the middle reinforcing member 20.

Figure 8B:
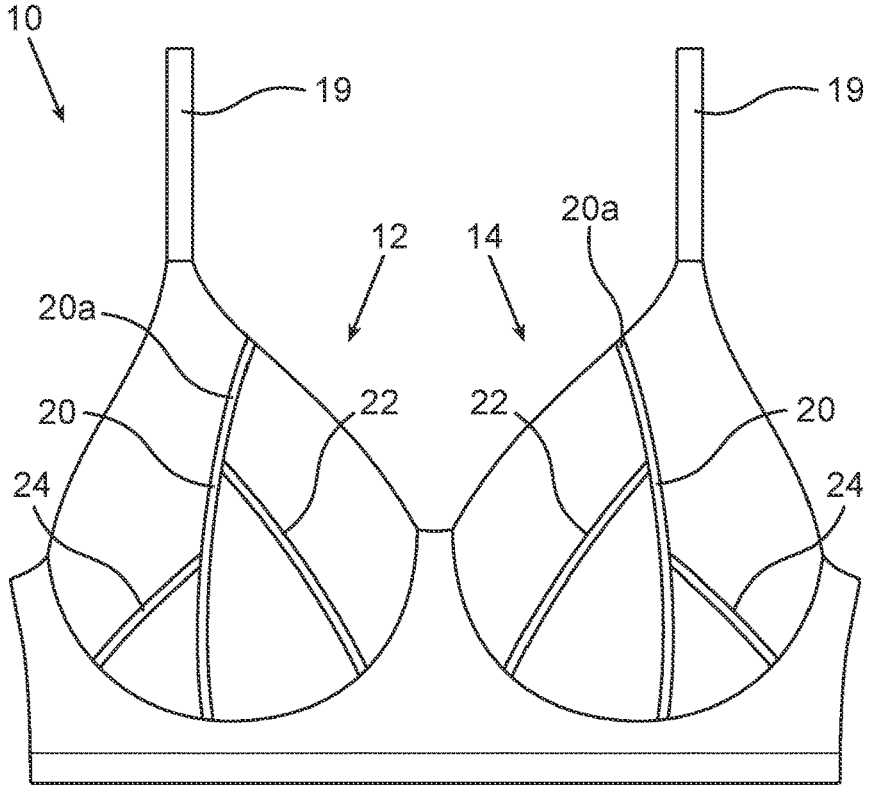
FIG. 8B is a schematic view of a pattern of three reinforcing members wherein two of the reinforcing members meet the third reinforcing member at different points along the third reinforcing member, in accordance with one embodiment.

In another implementation of option "(A)" above, as shown in FIG. 8B, the medial and lateral reinforcing members 22, 24 intersect with the third reinforcing member 20

(i.e. the middle reinforcing member 20) at different points along the middle reinforcing member 20.

Figure 8C:
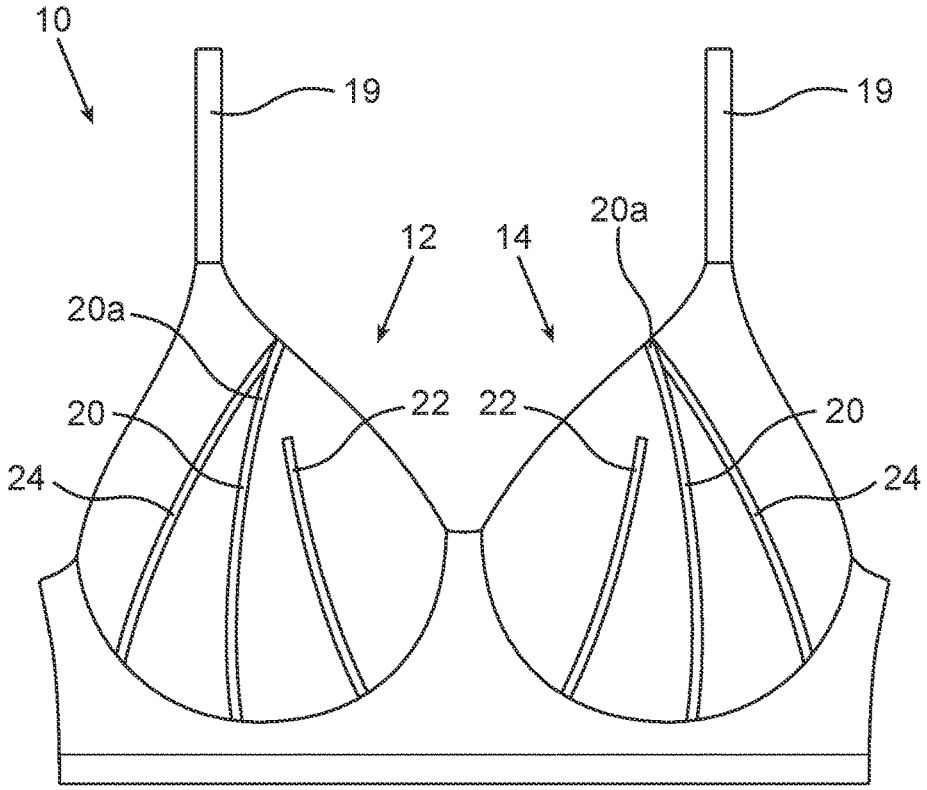
FIG. 8C is a schematic view of a pattern of three reinforcing members as in FIG. 8A but with at least one of the reinforcing members not intersecting with the middle reinforcing member, in accordance with one embodiment.

In another implementation of option "(A)" above, as shown in FIG. 8C, one of (or in other examples both of) the medial reinforcing member 22 and the lateral reinforcing member 24 does not extend so far as to intersect with the middle reinforcing member 20.

With respect to option "(B)" above, in some embodiments the pattern of reinforcing members shown in FIG. 8A may be modified such that both of the medial and lateral reinforcing members 22, 24 do not extend all the way to the middle reinforcing member 20, and in that case in some versions they would still be substantially symmetrical in relation to the middle reinforcing member 20 (provided the gap between each reinforcing member 22, 24 and the middle reinforcing member 20 were equal).

Figure 8D:
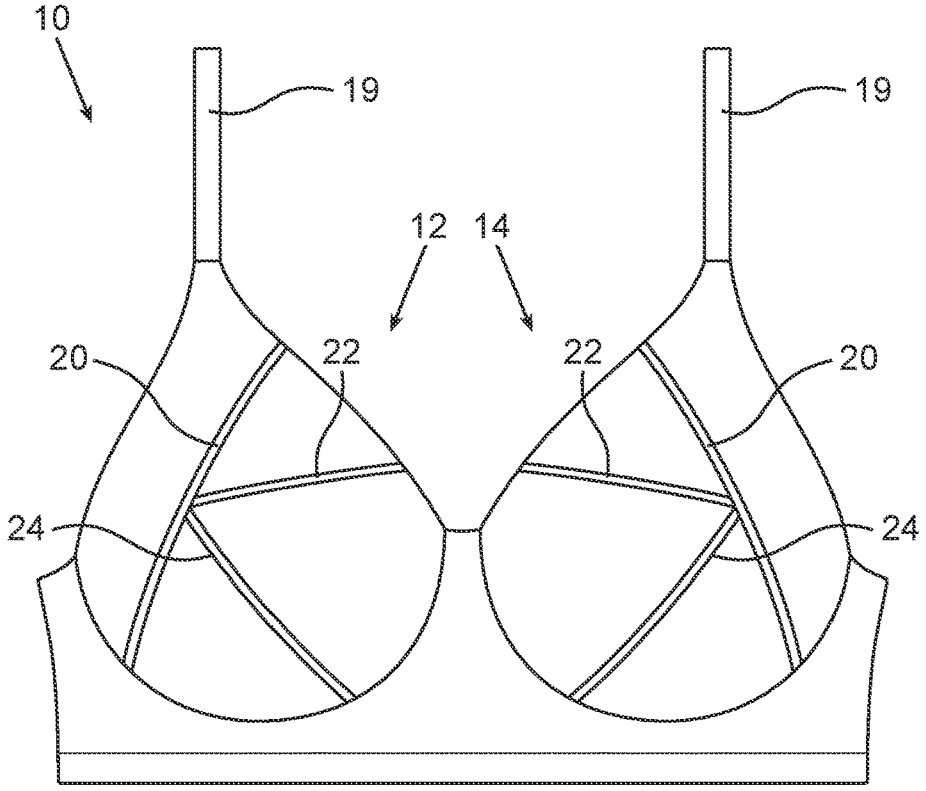
FIG. 8D is a schematic of a further pattern of three reinforcing members, in accordance with one embodiment.
Figure 9:
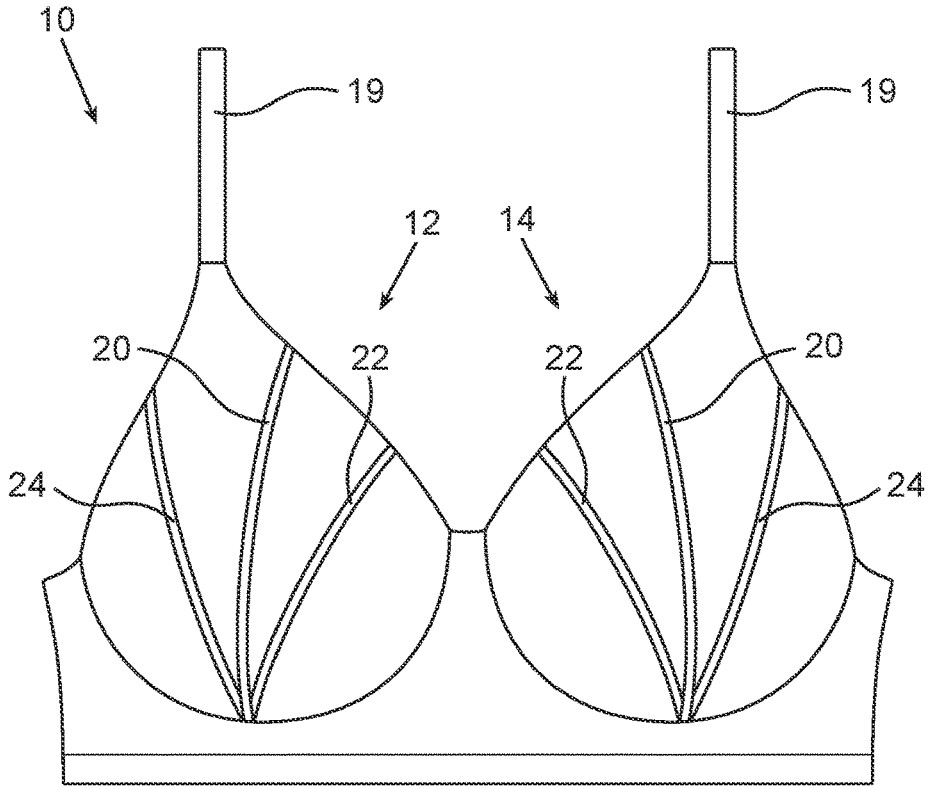
FIG. 9 is a schematic of a pattern of reinforcing members in a configuration of 180 degrees rotated relative to FIG. 8A, in accordance with one embodiment.

In some embodiments, moreover, as shown in FIG. 9, the pattern of FIG. 8A, FIG. 8B or FIG. 8C may be rotated 180 degrees from what is shown in these figures such that (for example in the case of the rotation of FIG. 8A or FIG. 8C) the three reinforcing members 20, 22, 24 meet (FIG. 8A) (or almost meet (FIG. 8C)) at or near a bottom of the cup 12, 14 rather than at the top. This rotation can be done also for the patterns shown in FIG. 8B, FIG. 8C and FIG. 8D.

In some embodiments, as seen in FIG. 8A, FIG. 8B and FIG. 8C, in each cup 12, 14, the middle reinforcing member 20 runs substantially vertically from a bottom to a top (which corresponds to the end of end region 20*a*) of the respective cup 12, 14. In addition, in some implementations, in each cup 12, 14 the medial and lateral reinforcing members 22, 24 meet the middle reinforcing member 20 at an angle of 30 degrees to 60 degrees. In some implementations, the medial reinforcing member 22 meets the lateral reinforcing member 24 at an angle of 70 to 110 degrees.

As shown in FIG. 8D, the three nonparallel reinforcing members 20, 22, 24 substantially form a letter "K". All references herein to a "K" encompass both a capital K as shown in FIG. 8D and a lower case "k" (not shown). The "K" formed by the three nonparallel reinforcing members may also be rotated from what is depicted in FIG. 8D either 90 degrees or 180 degrees or any other number of degrees. In the implementation shown in FIG. 8D, the three nonparallel reinforcing members include a first reinforcing member 20 that runs substantially vertically (from a top to a bottom of each cup 12, 14) and which may be referred to as the spine of the "K". In addition, the three reinforcing members include one or both of a second reinforcing member 22 and a third reinforcing member 24 (which may be referred to as the legs of the "K") that intersects with the first reinforcing member 20. In some implementations, the intersection makes an acute angle of about 30 degrees to about 80 degrees. In some implementations, the intersection makes an acute angle of about 30 degrees to about 60 degrees. Accordingly, in some implementations of the "K" pattern embodiment, one or both of the "legs" of the K may not extend far enough to intersect with the spine of the K (utilizing the non-intersecting feature shown in FIG. 8C (FIG. 8C not being a K pattern configuration)).

In certain embodiments, the collection of reinforcement members have both horizontal and vertical components so as to provide optimal stability.

In some embodiments, more than three reinforcement members are included.

In other embodiments, the two, three, four, five or six (or more) nonparallel reinforcing members in each cup 12, 14 substantially form certain other capital letters of the English alphabet not mentioned hitherto such as: A, B, C, D, E, F, G, M, N, P, R, S, W, X, Y, Z While the invention has been described with respect to a limited number of embodiments, it will be appreciated that many variations, modifications and other applications of the invention may be made. Therefore, the claimed invention, as recited in the claims that follow, is not limited to the embodiments described herein.

What is claimed is:

1. A brassiere, comprising:

a concave left cup and a concave right cup, each cup having an inside surface and an outside surface, each cup configured to receive a women's breast; and one or more of (i) left and right sides, (ii) a back and (iii) at least one strap, wherein each cup comprises (i) at least two reinforcing members and (ii) other material that does not comprise a reinforcing member, each reinforcing member of the at least two reinforcing members is more rigid than the other material adjacent the reinforcing member, wherein the at least two reinforcing members of each cup comprise one or more of the following:

(A) two reinforcing members that intersect to substantially form a T intersection, (B) three reinforcing members that intersect to substantially form an H, and (C) two reinforcing members that intersect to substantially form a plus sign.

2. The brassiere of claim 1, wherein the at least two reinforcing members of each cup comprise three reinforcing members that intersect to substantially form the H.

3. The brassiere of claim 2, wherein a crossbar of the H extends outwardly on each side of the H.

4. The brassiere of claim 1, wherein the at least two reinforcing members of each cup include two reinforcing members that intersect to substantially form the T intersection at an angle of from 75 to 90 degrees and at some point along an interval from one-quarter of a length of, to three-quarters of the length of, one of the two intersecting reinforcing members.

5. The brassiere of claim 1, wherein the at least two reinforcing members of each cup include two reinforcing members that intersect to substantially form a T intersection.

6. The brassiere of claim 5, wherein a first of the two reinforcing members that intersect to substantially form the T intersects with a second of the two reinforcing members that intersect to substantially form the T at an angle of between 50 and 90 degrees.

7. The brassiere of claim 5, wherein a first of the two reinforcing members that intersect to substantially form the T intersects with a second of the two reinforcing members that intersect to substantially form the T at an angle of between 70 and 90 degrees.

8. The brassiere of claim 5, wherein for each cup, one of the two reinforcing members that intersect to substantially form the T substantially bisects a surface area of the outside surface.

9. The brassiere of claim 5, wherein for each cup, both of the two reinforcing members of that intersect to substantially form the T occupy a surface area that is less than half of a surface area of the outside surface.

10. The brassiere of claim 1, wherein the at least two reinforcing members of each cup include two reinforcing members that intersect to substantially form a plus sign.

11. A brassiere, comprising:

a concave left cup and a concave right cup, each cup having an inside surface and an outside surface, each cup configured to receive a woman's breast; and one or more of (i) left and right sides, (ii) a back and (iii) at least one strap, wherein each cup comprises (i) two reinforcing members that intersect with one another at an angle of 70-90 degrees and (ii) other material that does not comprise a reinforcing member, each reinforcing member of the two reinforcing members is more rigid than the other material adjacent the reinforcing member.

12. The brassiere of claim 11, further comprising a third reinforcing member that intersects with each of the two reinforcing members.

13. The brassiere of claim 11, further comprising a third reinforcing member that intersects with each of the two reinforcing members so as to form at least one T intersection and so that the third reinforcing member substantially forms a leg or a top of the at least one T intersection.

14. The brassiere of claim 11, wherein the two reinforcing members intersect with one another at an angle of at 75-90 degrees.

15. The brassiere of claim 11, wherein the two reinforcing members intersect with one another at an angle of 80-90 degrees.

16. The brassiere of claim 11, wherein the two reinforcing members are substantially orthogonal to one another.

17. The brassiere of claim 11, wherein the two intersecting reinforcing members intersect at an angle of from 75 to 90 degrees and at some point along an interval from one-quarter of a length of, to three-quarters of the length of, the one of the two intersecting reinforcing members.

18. A brassiere, comprising:

a concave left cup and a concave right cup, each cup having an inside surface and an outside surface, each cup configured to receive a women's breast; and one or more of (i) left and right sides, (ii) a back and (iii) at least one strap, wherein each cup includes (i) at least three reinforcing members and (ii) other material that does not comprise a reinforcing member, each reinforcing member of the at least three reinforcing members is more rigid than the other material adjacent the reinforcing member, wherein the at least three reinforcing members of each cup include two reinforcing members that substantially form a first T intersection and two reinforcing members that substantially form a second T intersection, wherein one of the at least three reinforcing members of each cup represents a leg of the first T intersection and represents a top of the second T intersection.

19. The brassiere of claim 18, wherein two of the at least three reinforcing members are substantially parallel to one another.

20. The brassiere of claim 19, wherein the two of the at least three reinforcing members that are substantially parallel do not include the one of the three reinforcing members that represents a leg of the first T intersection and represents a top of the second T intersection.

21. The brassiere of claim 18, wherein for each particular cup of the left cup and right cup, one of the three reinforcing members extends from a bottom to a top of the particular cup.

22. The brassiere of claim 18, wherein the two reinforcing members that substantially form the first T intersection intersect at an angle of from 75 to 90 degrees.

23. The brassiere of claim 18, wherein the two reinforcing members that substantially form the first T intersection intersect at an angle of from 75 to 90 degrees at some point along an interval from one-quarter of a length of, to three-quarters of the length of, the one of the two reinforcing members that represents the top of the first T intersection.

24. A brassiere, comprising:

a concave left cup and a concave right cup, each cup having an inside surface and an outside surface, each cup configured to receive a women's breast; and one or more of (i) left and right sides, (ii) a back and (iii) at least one strap, wherein each cup comprises (i) three nonparallel reinforcing members and (ii) other material that does not comprise a reinforcing member, each nonparallel reinforcing member of the three nonparallel reinforcing members is more rigid than the other material adjacent the nonparallel reinforcing member.

25. The brassiere of claim 24, wherein the three nonparallel reinforcing members include a medial reinforcing member, a middle reinforcing member and a lateral reinforcing member, wherein either (A) at least one of the medial and lateral reinforcing members intersects the middle reinforcing member or (B) the medial and lateral reinforcing members are substantially symmetrical in relation to the middle reinforcing member.

26. The brassiere of claim 25, wherein in each cup the middle reinforcing member runs substantially vertically from a bottom to a top of the respective cup.

27. The brassiere of claim 25, wherein in each cup the medial and lateral reinforcing members intersect the middle reinforcing member at an angle of 30 degrees to 60 degrees.

28. The brassiere of claim 25, wherein the medial reinforcing member intersects the lateral reinforcing member at an angle of 70 to 110 degrees.

29. The brassiere of claim 25, wherein the three reinforcing members intersect.

30. The brassiere of claim 29, wherein each of the medial and lateral reinforcing members intersect the middle reinforcing member.

31. The brassiere of claim 24, wherein the three nonparallel reinforcing members include a first reinforcing member that is substantially vertical and a second and third reinforcing member at least one of which intersects with the first reinforcing member.

32. The brassiere of claim 24, wherein the three nonparallel reinforcing members substantially form a K.

33. The brassiere of claim 24, wherein all of the three nonparallel reinforcing members intersect with one another.

* * * * *